US008213819B2

(12) United States Patent
Nakatani et al.

(10) Patent No.: US 8,213,819 B2
(45) Date of Patent: Jul. 3, 2012

(54) FIXING APPARATUS AND IMAGE FORMING APPARATUS

(75) Inventors: Hiroshi Nakatani, Osaka (JP); Yoshinobu Tateishi, Osaka (JP); Atsushi Ide, Osaka (JP); Kimihide Tsukamoto, Osaka (JP); Takashi Yamanaka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 434 days.

(21) Appl. No.: 12/435,487

(22) Filed: May 5, 2009

(65) Prior Publication Data

US 2009/0285592 A1 Nov. 19, 2009

(30) Foreign Application Priority Data

May 14, 2008 (JP) ..... 2008-127470

(51) Int. Cl.
*G03G 15/20* (2006.01)

(52) U.S. Cl. ..... 399/70; 219/216; 399/69; 399/330; 399/335

(58) Field of Classification Search ..... 399/69, 399/70, 328, 330, 331, 335; 219/216
See application file for complete search history.

(56) References Cited

U.S. PATENT DOCUMENTS

| | | | | |
|---|---|---|---|---|
| 5,671,462 | A * | 9/1997 | Toyohara et al. | 399/33 |
| 6,996,363 | B2 * | 2/2006 | Aoki et al. | 399/334 |
| 7,027,749 | B2 * | 4/2006 | Kamei | 399/69 |
| 7,308,216 | B2 * | 12/2007 | Kishi et al. | 399/70 |
| 7,333,743 | B2 * | 2/2008 | Kishi et al. | 399/69 |
| 7,343,113 | B2 * | 3/2008 | Matsusaka et al. | 399/69 |
| 7,361,863 | B2 * | 4/2008 | Tsunoda | 219/216 |
| 7,373,094 | B2 * | 5/2008 | Kishi et al. | 399/69 |
| 7,551,869 | B2 * | 6/2009 | Kishi et al. | 399/69 |
| 7,609,988 | B2 * | 10/2009 | Kishi et al. | 399/69 |
| 7,664,416 | B2 * | 2/2010 | Watabe | 399/69 |
| 7,949,274 | B2 * | 5/2011 | Furuyama | 399/69 |
| 2003/0190170 | A1 * | 10/2003 | Hamada et al. | 399/69 |
| 2006/0067721 | A1 | 3/2006 | Fujisawa | |

FOREIGN PATENT DOCUMENTS

| | | | |
|---|---|---|---|
| JP | 2001201978 | A * | 7/2001 |
| JP | 2003-280444 | | 10/2003 |
| JP | 2005221851 | A * | 8/2005 |
| JP | 2006-047336 | | 2/2006 |
| JP | 2006-106031 | | 4/2006 |
| JP | 2007-003641 | | 1/2007 |

* cited by examiner

*Primary Examiner* — David Gray
*Assistant Examiner* — Fred L Braun
(74) *Attorney, Agent, or Firm* — Renner, Otto, Boisselle & Sklar, LLP

(57) ABSTRACT

In a fixing apparatus provided with a plurality of fixing heaters having heat distribution characteristics that are different from each other inside a fixing roller, and an image forming apparatus provided with the fixing apparatus, an auxiliary heater is provided, the auxiliary heater being provided inside the fixing roller and to which power is distributed only during the warm-up period until the fixing roller in a lower temperature state reaches a predetermined fixing temperature. The plurality of fixing heaters includes a first fixing heater having first heat distribution characteristics that mainly heats a center portion of the fixing roller, and a second fixing heater having second heat distribution characteristics that mainly heats both end portion regions of the fixing roller.

3 Claims, 8 Drawing Sheets

FIG.8(a)

Warm-up period

| | | | | | | | | | |
|---|---|---|---|---|---|---|---|---|---|
| RTH1 | First temperature sensor | L | L | L | L | HH | HH | HH | HH |
| RTH2 | Second temperature sensor | L | L | HH | HH | L | L | HH | HH |
| PRTH | Pressure roller temperature sensor | L | HH | L | HH | L | HH | L | HH |
| HL1(480W) | Main heater | 480 | 480 | 480 | 480 | OFF | OFF | OFF | OFF |
| HL2(510W) | Sub heater | 510 | 510 | OFF | OFF | 510 | 510 | OFF | OFF |
| HL3(300W) | Pressure roller heater | OFF | OFF | 300 | OFF | 300 | OFF | 300 | OFF |
| HL4(300W) | Auxiliary heater | 300 | 300 | 300 | 300 | OFF | OFF | OFF | OFF |
| | total | 1290 | 1290 | 1080 | 780 | 810 | 510 | 300 | 0 |

FIG.8(b)

Stand-by period (for example, 50° C) HL4 turned off

| | | | | | | | | | |
|---|---|---|---|---|---|---|---|---|---|
| RTH1 | First temperature sensor | L | L | L | L | HH | HH | HH | HH |
| RTH2 | Second temperature sensor | L | L | HH | HH | L | L | HH | HH |
| PRTH | Pressure roller temperature sensor | L | HH | L | HH | L | HH | L | HH |
| HL1(480W) | Main heater | 480 | 480 | 480 | 480 | OFF | OFF | OFF | OFF |
| HL2(510W) | Sub heater | 510 | 510 | OFF | OFF | 510 | 510 | OFF | OFF |
| HL3(300W) | Pressure roller heater | 300 | OFF | 300 | OFF | 300 | OFF | 300 | OFF |
| HL4(300W) | Auxiliary heater | OFF | OFF | OFF | OFF | OFF | OFF | OFF | OFF |
| | total | 1290 | 990 | 780 | 480 | 810 | 510 | 300 | 0 |

FIG.8(c)

Copying period (for example, 150° C) HL4 turned off

| | | | | | | | | | |
|---|---|---|---|---|---|---|---|---|---|
| RTH1 | First temperature sensor | L | L | L | L | HH | HH | HH | HH |
| RTH2 | Second temperature sensor | L | L | HH | HH | L | L | HH | HH |
| PRTH | Pressure roller temperature sensor | L | HH | L | HH | L | HH | L | HH |
| HL1(480W) | Main heater | 480 | 480 | 480 | 480 | OFF | OFF | OFF | OFF |
| HL2(510W) | Sub heater | 510 | 510 | OFF | OFF | 510 | 510 | OFF | OFF |
| HL3(300W) | Pressure roller heater | OFF | OFF | 300 | OFF | 300 | OFF | 300 | OFF |
| HL4(300W) | Auxiliary heater | OFF | OFF | OFF | OFF | OFF | OFF | OFF | OFF |
| | total | 990 | 990 | 780 | 480 | 810 | 510 | 300 | 0 |

FIXING APPARATUS AND IMAGE FORMING APPARATUS

CROSS-REFERENCE TO RELATED APPLICATIONS

This application claims priority under 35 U.S.C. §119(a) on Patent Application No. 2008-127470 filed in Japan on May 14, 2008, the entire contents of which are herein incorporated by reference.

BACKGROUND OF THE INVENTION

1. Field of Invention

The present invention relates to a fixing apparatus used in an image forming apparatus such as a copier, a printer, and a facsimile apparatus; and particularly relates to a fixing apparatus having a fixing heater that heats a fixing roller from inside the fixing roller, and to an image forming apparatus provided with such a fixing apparatus.

2. Related Art

A conventional image forming apparatus such as a copier, a printer, and a facsimile apparatus is configured, for example, so as to form a toner image on a sheet such as recording paper using a toner, and to heat and fix the obtained unfixed toner image on the sheet using a fixing apparatus. For example, in a conventional image forming apparatus in which image-forming is performed by an electrophotographic image-forming process, an image is formed on a sheet by charging the surface of an image carrier such as a photosensitive body, forming an electrostatic latent image in the charging area by exposing it to an image, electrostatically transferring a toner image that is formed by developing the electrostatic latent image using a developer to the sheet, and fixing the unfixed toner image that was transferred to the sheet using the fixing apparatus.

In a fixing apparatus used in such a conventional image forming apparatus, generally, an unfixed toner image on the sheet is fixed by allowing the unfixed toner image on the sheet to pass through a fixing nip portion between a hot roller and a pressure roller of the fixing apparatus.

To be specific, conventional fixing apparatuses are generally provided with a fixing heater inside the fixing roller, and fixing is performed by heating the fixing roller using such an internal fixing heater to a predetermined fixing temperature, and pressing and heating the sheet with the unfixed toner image formed thereon while allowing the sheet with the unfixed toner image to pass through the fixing nip portion between the heated fixing roller and pressure roller, so as to bring the unfixed toner image into contact with the fixing roller. However, when performing this fixing operation, sometimes the temperature distribution declines in a part of the region of the fixing roller in the longitudinal direction to a temperature lower than the fixing temperature in that part.

In view of the above, in a conventional fixing apparatus, a plurality of fixing heaters having heat distribution characteristics that are different from each other are provided inside the fixing roller, and the temperature distribution of the fixing roller in the longitudinal direction is kept at the fixing temperature.

For example, JP2003-280444A has proposed a fixing apparatus that prevents temperature drops that may occur due to poor temperature responsiveness in a partial region of a fixing roller in the longitudinal direction by differentiating the heat distribution of a plurality of heating means (fixing heaters) and performing control so as to shift the state of a heating means from a non-operating state to an operating state in order from a heating means with a concentrated heat distribution amount at the center portion of the paper passage area among the plurality of heating means, not simultaneously shifting the state of the heating means from a non-operating state to an operating state, or not simultaneously shifting the state of the heating means from an operating state to a non-operating state.

Meanwhile, power distribution to the fixing heater is stopped while the main power supply is OFF and the fixing roller has a normal temperature (a temperature not heated by the fixing heater). Furthermore, while in a stand-by (power-saving: energy-saving) mode in which an image-forming operation is not performed, the stand-by temperature of the fixing heater is controlled, and the temperature of the fixing roller is kept at a stand-by temperature (a predetermined temperature that is lower than the fixing temperature).

Then, when the main power supply that has been turned OFF is turned ON, during the warm-up period until the fixing roller in a lower temperature (normal temperature) state reaches the fixing temperature (until entering ready state), power is distributed to the fixing heater; and upon entering the ready state, fixing temperature control is performed on the fixing heater so as to keep the temperature of the fixing roller at the fixing temperature. Meanwhile, when a stand-by mode cancel instruction is given, control of the fixing heater is switched from the stand-by temperature control to the fixing temperature control, during the warm-up period which is until the fixing roller in a lower temperature state (having a stand-by temperature) reaches the fixing temperature. The temperature of the fixing roller in the low temperature state is thus raised so that the fixing heater has a fixing temperature.

During this warm-up period, it is required that the fixing roller is given an appropriate temperature that can ensure fixing quality (excellent fixing ability) in a short period of time. Therefore, recently, the electrical power (calorific value) of the heater has increased significantly.

However, although the time required to raise the temperature to a required temperature condition can be shortened by quickly heating the fixing roller using the fixing apparatus having a fixing heater with increased electrical power (calorific value), there is a limitation in increasing the capacity of the fixing heater because consideration needs to also be given to, for example, limitations from the current ratings and the like of indoor circuit breakers provided at the place where the apparatus is located.

Thus, an important task is to efficiently raise the temperature of the fixing roller during the warm-up period somehow. The same goes for the above-described fixing apparatus, that is, the fixing apparatus having a plurality of fixing heaters having heat distribution characteristics that are different from each other inside the fixing roller.

From such a standpoint, although the fixing apparatus described in JP2003-280444A can prevent a temperature drop that may occur due to poor temperature responsiveness in a partial region of the fixing roller in the longitudinal direction, no consideration is given to efficiently raising the temperature of the fixing roller during the warm-up period.

SUMMARY OF THE INVENTION

The present invention provides a fixing apparatus provided with a plurality of fixing heaters having heat distribution characteristics that are different from each other inside the fixing roller, and an image forming apparatus provided with the fixing apparatus, in which the temperature of the fixing roller can be raised efficiently during a warm-up period and, thus, the warm-up period can be shortened.

The present invention provides the following fixing apparatus and image forming apparatus.

(1) Fixing Apparatus

A fixing apparatus provided in an image forming apparatus and including a fixing roller, the fixing apparatus comprising:

a plurality of fixing heaters provided inside the fixing roller and having heat distribution characteristics that are different from each other, and an auxiliary heater provided inside the fixing roller, to which power is distributed only during a warm-up period until the fixing roller in a lower temperature state reaches a predetermined fixing temperature.

(2) Image Forming Apparatus

An image forming apparatus comprising:

the fixing apparatus according to the present invention, a temperature measurement unit (a temperature measurement means) that measures a temperature of the fixing roller, and a control unit (a control means) that controls the temperature of the fixing roller based on the measurement value from the temperature measurement unit, wherein the control unit distributes power to the auxiliary heater during the warm-up period, and when it is detected that the fixing roller has reached the fixing temperature based on the measurement value from the temperature measurement unit, stops to distribute power to the auxiliary heater.

According to the fixing apparatus and image forming apparatus of the present invention, by including the auxiliary heater to which power is distributed only during the warm-up period, raising of the temperature of the fixing roller during the warm-up period can be efficiently performed. Thus, the warm-up period can be shortened.

According to the fixing apparatus of the present invention, when the temperature distribution becomes low in a partial region of the fixing roller in the longitudinal direction heated by the plurality of fixing heaters, heat distribution characteristics of the auxiliary heater are preferably such that a heat distribution corresponding to the partial region where the temperature distribution is low in the fixing roller is high.

Based on such characteristics, the temperature distribution in the fixing roller can be ensured, and raising of the temperature of the fixing roller during the warm-up period can be efficiently performed.

To be specific, an example such as the following can be given: the plurality of fixing heaters include a first fixing heater having heat distribution characteristics by which a first heat distribution that mainly heats a center portion region of a predetermined length along the longitudinal direction of the fixing roller is higher than a second heat distribution that mainly heats both end portion regions other than the center portion region, and a second fixing heater having heat distribution characteristics by which second heat distributions that mainly heat the both end portion regions of the fixing roller are higher than a first heat distribution that mainly heats the center portion region.

Meanwhile, in the fixing apparatus, in order to eliminate projections at one end portion side in the longitudinal direction of the fixing roller (for example, the front side in the width direction that is perpendicular to the sheet transport direction when the fixing apparatus is placed in the image forming apparatus), generally, the outer dimensional size thereof in the longitudinal direction at the one end portion side (for example, front side) is set to be narrow (no extra space). On the other hand, when one end portion region (for example, front side region) of the fixing roller is set larger, the outer dimensional size of the one end portion of the fixing apparatus (for example, front side) becomes large. Thus, when the outer dimensional size in the longitudinal direction is set to be narrow at the one end portion side of the fixing apparatus (for example, front side), sometimes, in the heat distribution characteristics of the second fixing heater, one heat distribution becomes narrower than the other heat distribution among the second heat distributions that mainly heat the both ends portion regions. Thus, the temperature distribution cannot be ensured in the one end portion region among the both end portion regions, and therefore when the temperature distribution is tried to be ensured in the one end portion region, it takes time for the fixing roller to reach the fixing temperature throughout the entire length in the longitudinal direction to that extent.

Therefore, in such a configuration, the heat distribution characteristics of the auxiliary heater preferably are such that a first heat distribution that mainly heats the one end portion region of the both end portion regions is higher than a second heat distribution that mainly heats a region other than the one end portion region.

Based on such characteristics, temperature distribution at the one end portion region in the fixing roller can be ensured, and raising of the temperature of the fixing roller during the warm-up period can be further efficiently performed.

In an example of an embodiment of an image forming apparatus according to the present invention, a pressure roller for applying pressure toward the fixing roller, and a pressure roller fixing heater provided inside the pressure roller, may be further included. In this case, the control unit does not distribute power to the pressure roller fixing heater when power is distributed to the auxiliary heater.

Based on such characteristics, the temperature of the fixing roller can be efficiently raised while suppressing the amount of electrical power during the warm-up period.

As described above, the present invention can provide a fixing apparatus provided with a plurality of fixing heaters having heat distribution characteristics that are different from each other inside the fixing roller, and an image forming apparatus provided with the fixing apparatus, in which the temperature of the fixing roller can be raised efficiently during the warm-up period and, thus, the warm-up period can be shortened.

BRIEF DESCRIPTION OF THE DRAWINGS

FIG. 3(*a*) is a graph illustrating the heat distribution characteristics of a main heater, FIG. 3(*b*) is a graph illustrating the heat distribution characteristics of a sub heater, and FIG. 3(*c*) is a graph illustrating the heat distribution characteristics of an auxiliary heater.

FIG. 4(*a*) shows the case where the fixing roller is heated not only by the main heater and the sub heater but also by the auxiliary heater during the warm-up period, and FIG. 4(*b*) shows the case where the fixing roller is heated only by the main heater and the sub heater, and is not heated by the auxiliary heater during the warm-up period.

FIG. 5(*a*) is a side view of the heaters, and FIG. 5(*b*) is a front view of the heaters in the direction of arrow b in FIG. 5(*a*).

FIG. 6(*a*) shows the case where a first heat distribution is set higher than a second heat distribution in the heat distribution characteristics of the auxiliary heater, and FIG. 6(*b*) shows the case where the heat distribution characteristics of the auxiliary heater are uniform throughout the entire length in the longitudinal direction of the fixing roller.

FIG. 8(*a*) to FIG. 8(*c*) are diagrams illustrating examples of control tables storing heater power-on conditions for performing power distribution control to the heaters based on the temperature measurement values from the temperature sensor through the control unit provided in the image forming apparatus shown in FIG. 1: FIG. 8(*a*) shows heater power-on conditions for the warm-up period, FIG. 8(*b*) shows heater power-on conditions for the stand-by period, and FIG. 8(*c*) shows heater power-on conditions for the ready period.

DESCRIPTION OF THE PREFERRED EMBODIMENTS

Hereinafter, an embodiment of the present invention will be described with reference to the drawings. The following embodiment is a specific example of the present invention, and is not of a nature that limits the technical scope of the present invention.

Figure 1:
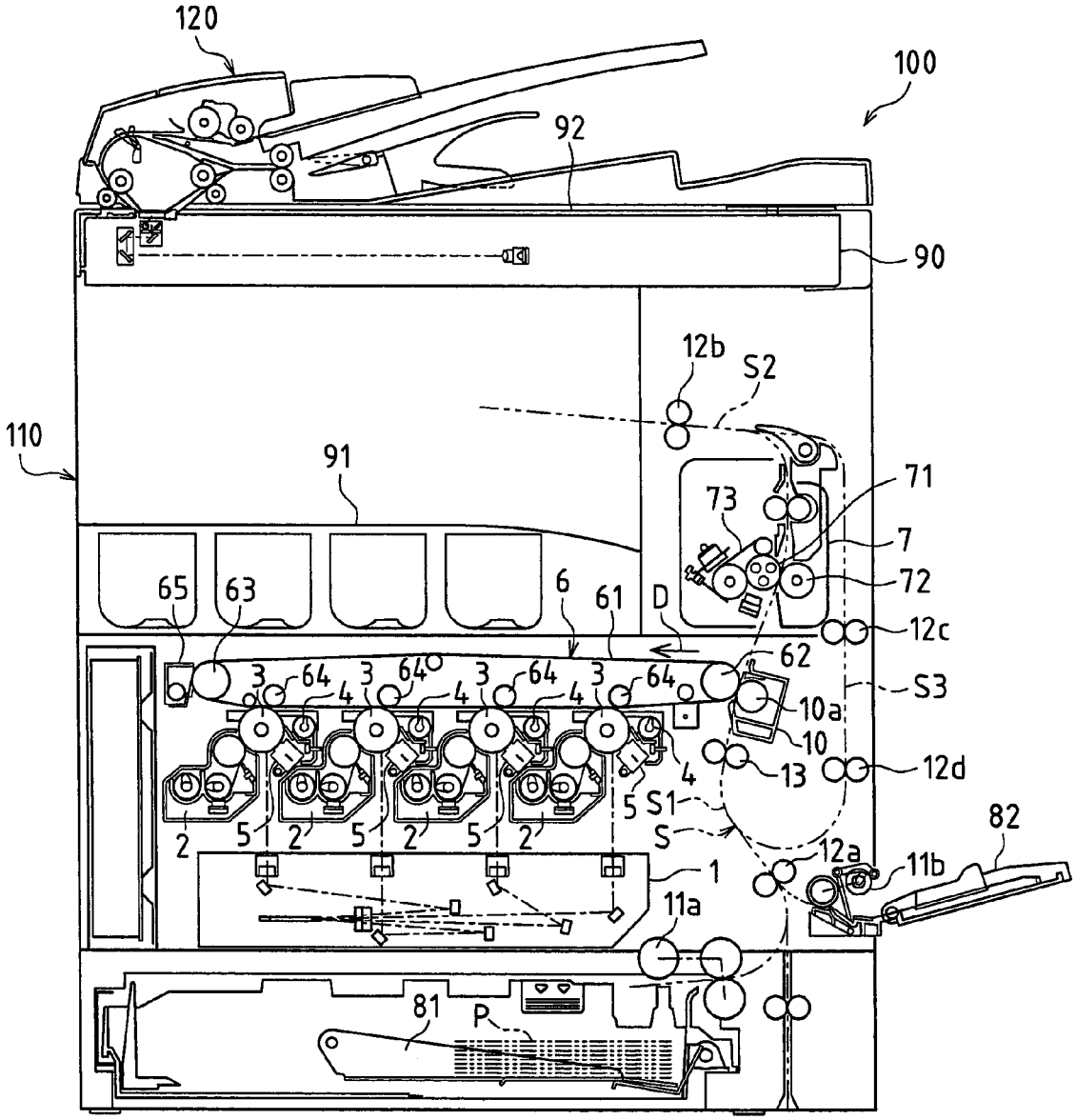
FIG. 1 is a side view illustrating a schematic configuration of an image forming apparatus provided with a fixing apparatus according an embodiment of the present invention.

FIG. 1 is a side view illustrating a schematic configuration of an image forming apparatus provided with a fixing apparatus according to this embodiment.

[Overall Configuration of Image Forming Apparatus]

An image forming apparatus 100 shown in FIG. 1 forms a toner image on a sheet P such as recording paper using a toner.

An apparatus main body 110 is provided with image carriers (herein, photosensitive drums) 3, charging apparatuses (herein, charging units) 5 for charging the surface of the photosensitive drums 3, exposing apparatus (herein, exposing unit) 1 for forming an electrostatic latent image on the photosensitive drums 3, development apparatuses (herein, development unit) 2 for making the electrostatic latent image visible with a toner and forming a toner image on the photosensitive drums 3, an intermediate transfer unit (herein, intermediate transfer belt) 61, primary transfer apparatuses (herein, intermediate transfer rollers) 64 that transfer the toner image on the photosensitive drums 3 temporarily to the intermediate transfer belt 61, a primary cleaning apparatus (herein, cleaner unit) 4 that removes residual toner that remains on the surface of the photosensitive drums 3 without being transferred by the intermediate transfer rollers 64, a secondary transfer apparatus (herein, secondary transfer unit) 10 that transfers the toner image on the intermediate transfer belt 61 to the sheet P, a secondary cleaning apparatus (herein, intermediate transfer belt cleaning unit) 65 that removes the residual toner that remains on the surface of the intermediate transfer belt 61 without being transferred by the secondary transfer unit 10, and a fixing apparatus 7 that fixes the toner image on the sheet P by heating and melting, and firmly attaching the toner image formed on the sheet P.

This image forming apparatus 100 is also provided with, in addition to the above configuration, a transport path S of the sheet P, pairs of transport rollers 12*a* to 12*d* that are arranged on both sides along the transport path S, an original reading apparatus (herein, scanner apparatus) 90 that reads the image of the original, an original placement stage 92 on which the original is placed, and an automatic original processing apparatus 120.

The original reading apparatus 90 is provided on top of the apparatus main body 110. On the upper side of the original reading apparatus 90, an original placement stage 92 made of transparent glass is provided and, further, the automatic original processing apparatus 120 is attached on the upper side of the original placement stage 92. The automatic original processing apparatus 120 automatically transports the original onto the original reading apparatus 90. Also, the automatic original processing apparatus 120 is rotatable around a pivot axis along the original transport direction, and the original can be placed with the hands by opening the top of the original placement stage 92. The original reading apparatus 90 can thus read the image of the original transported by the automatic original processing apparatus 120, or the image of the original placed on the original placement stage 92.

The image forming apparatus 100 is configured to then form multicolor and unicolor images on the sheet P, according to the image data corresponding to the original read by the original reading apparatus 90 or image data externally transmitted.

To further describe, image data processed in the image forming apparatus 100 is based on color images employing each of black (K), cyan (C), magenta (M), and yellow (Y), or based on monochrome images employing unicolor (for example, black). Therefore, four each of the development apparatus 2, the photosensitive drum 3, the charging unit 5, the cleaner unit 4, and the intermediate transfer roller 64 are provided corresponding to the respective colors so as to form four types of images.

That is, four of these members are set to black, cyan, magenta, and yellow, respectively, and an image station is configured with these members.

The charging unit 5 is a charging means for charging the surface of the photosensitive drums 3 uniformly to a predetermined potential. For the charging unit 5, a contact type charging unit (for example, roller type or brush type), or a charger type charging unit as shown in FIG. 1 can be used.

The exposing unit 1 has a function of forming electrostatic latent images on the surface of the photosensitive drums 3 according to input image data by exposing the surface of the charged photosensitive drums 3 to light according to the image data. To be specific, optical elements such as a polygon mirror that causes a laser beam to scan, and lenses and mirrors for guiding the laser light reflected by the polygon mirror to the photosensitive drum 3 are disposed in the exposing unit 1.

For this exposing unit 1, a laser scanning unit (LSU) including laser irradiating portions and reflecting mirrors, or a writing apparatus (for example, a writing head) in which light-emitting elements such as ELs and LEDs are arranged in an array may also be used.

The development apparatuses 2 make the electrostatic latent images formed on the photosensitive drums 3 visible (visualize) by using four colors of toner (Y, M, C, and K). The cleaner units 4 remove and collect residual toner on the surfaces of the photosensitive drums 3 after development and transfer of an image.

An intermediate transfer belt unit 6 is disposed above the photosensitive drums 3. This intermediate transfer belt unit 6 is provided with an intermediate transfer belt drive roller 62 and an intermediate transfer belt idler roller 63, in addition to the above described intermediate transfer belt 61, intermediate transfer rollers 64, and intermediate transfer belt cleaning unit 65.

The rollers such as the intermediate transfer belt drive roller 62, the intermediate transfer rollers 64, and the intermediate transfer belt idler roller 63 are configured so that the intermediate transfer belt 61 is stretched and supported, and the surface of the intermediate transfer belt 61 can be moved in a predetermined direction (direction of arrow D in the figure).

The intermediate transfer rollers 64 are supported rotatably at a side opposite the photosensitive drums 3 with the intermediate transfer belt 61 interposed therebetween. The intermediate transfer rollers 64 apply a transfer bias to transfer the toner image on the photosensitive drums 3 to the intermediate transfer belt 61.

The intermediate transfer belt 61 is provided so as to be in contact with the respective photosensitive drums 3, and has a function of forming a color toner image (multicolor toner image) on the intermediate transfer belt 61 by successively superimposing and transferring the toner image of each color formed on the photosensitive drums 3 to the intermediate transfer belt 61. The intermediate transfer belt 61 is formed so as to have no end, using a film having a thickness of about 100 μm to 150 μm.

The transfer of the toner image from the photosensitive drums 3 to the intermediate transfer belt 61 is performed by the intermediate transfer rollers 64 that are in contact with the reverse side (that is, at a side the reverse of which is the side of the intermediate transfer belt 61 facing the photosensitive drum 3) of the intermediate transfer belt 61. A high voltage transfer bias for transferring the toner image to the intermediate transfer belt 61 is applied, that is, a high voltage transfer bias that has an opposite polarity (for example, polarity of (+)) to the polarity of the toner (for example, polarity of (−)) is applied to the intermediate transfer rollers 64. Here, the intermediate transfer rollers 64 are rollers that are based on a metal (for example, stainless steel) rotatable shaft having a diameter of 8 mm to 10 mm and whose surfaces are covered with a conductive elastic material (for example, materials made of EPDM, urethane foam, and the like). This conductive elastic material allows the intermediate transfer rollers 64 to apply a high voltage uniformly to the intermediate transfer belt 61. In this embodiment, a roller-shaped transfer electrode is used, but a brush type can also be used, without limitation.

The toner images that have been made visible (visualized) with each color of the toner on the photosensitive drums 3 as described above are laminated on the intermediate transfer belt 61. Thus, the laminated toner image of each color is transferred onto the sheet P by the rotation of the intermediate transfer belt 61, by the secondary transfer unit 10 that is disposed at the transfer portion where the sheet P and the intermediate transfer belt 61 face each other.

The intermediate transfer belt 61 and a transfer roller 10*a* of the secondary transfer unit 10 are pressed against each other, forming a nip region. Also, a voltage for transferring the toner images of each color on the intermediate transfer belt 61 to the sheet P, that is, a voltage with opposite polarity (for example, polarity of (+)) to the charge polarity (for example, polarity of (−)) of the toner is applied to the transfer roller 10*a* of the secondary transfer unit 10. Further, in order to steadily obtain the above nip region, a hard material such as that of a metal roller is used for either the rollers of the secondary transfer unit 10 or the intermediate transfer belt drive roller 62, and a soft material such as that of an elastic roller or the like (for example, a soft material such as elastic rubber or foam resin) is used for the other.

Meanwhile, there may be a case where the toner images of each color on the intermediate transfer belt 61 are not completely transferred onto the sheet P by the secondary transfer unit 10, and the toner remains on the intermediate transfer belt 61. Such residual toner becomes a cause of mixed color toner generated in the next process.

Thus, the intermediate transfer belt cleaning unit 65 is configured so as to remove and collect the residual toner. For example, the intermediate transfer belt cleaning unit 65 is provided with a cleaning blade, as a cleaning member, that is brought into contact with the intermediate transfer belt 61. This cleaning blade is supported at the reverse side of the intermediate transfer belt 61 (that is, at a side opposite the idler roller 63 of the intermediate transfer belt 61) at a position facing the intermediate transfer belt idler roller 63.

The image forming apparatus 100 is further provided with a paper feed cassette 81, a manual paper feed cassette 82, and a discharge portion 91.

The paper feed cassette 81 is for storing sheets P to be used for image-forming, and is provided at the lower side of the apparatus main body 110. Sheets to be used for image-forming can also be placed at the manual paper feed cassette 82. The discharge portion 91 is provided at an upper portion of the apparatus main body 110, and in this embodiment, is a discharge tray. This discharge portion 91 is a tray for placing the sheet P after image-forming face down.

Furthermore, the apparatus main body 110 is provided with a main transport path S1, that is substantially S-shaped for sending the sheet P of the paper feed cassette 81 or the manual paper feed cassette 82 to the discharge portion 91 through the secondary transfer unit 10 and the fixing apparatus 7.

Furthermore, pickup rollers 11*a* and 11*b*, registration rollers 13, the secondary transfer unit 10, and the fixing apparatus 7 are arranged along the main transport path S1 from the paper feed cassette 81 or the manual paper feed cassette 82 to the discharge portion 91.

The transport rollers 12*a* to 12*d* are small rollers for accelerating and assisting, for example, the transportation of the sheet P, and are provided along the transport path S. The transport path S is configured of, other than the main transport path S1, a switchback transport path S2 and a reverse transport path S3.

The pickup rollers 11*a* and 11*b* are provided in the proximity of the end portion of the paper feed cassette 81 and the manual paper feed cassette 82, respectively, and are pull-in rollers that supply sheets P one by one from the paper feed cassette 81 and the manual paper feed cassette 82 to the main transport path S1.

Furthermore, the registration rollers 13 temporally hold the sheet P that is transported from the paper feed cassette 81, and align the leading edge of the sheet P. The registration rollers 13 have a function of transporting the sheet P with good timing in synchronization with the toner image of the intermediate transfer belt 61.

The fixing apparatus 7 fixes the unfixed toner image on the sheet P by heating and melting, and attaching firmly the unfixed toner image formed on the sheet P. The fixing apparatus 7 is described later on.

In the above-described image forming apparatus 100, at the time of a request for simplex image-forming, first, the sheet P transported from the paper feed cassette 81 or the manual paper feed cassette 82 is transported to the registration rollers 13 by the transport rollers 12*a* on the main transport path S1. Then, the sheet P is transported to the transfer portion in synchronization with the toner image on the intermediate transfer belt 61 by the registration rollers 13. The toner image on the intermediate transfer belt 61 is transferred onto the sheet P that has been transported to the transfer portion, with the transfer electric field applied at the secondary transfer unit 10. Afterwards, by passing the sheet P through the fixing apparatus 7, the unfixed toner that has been transferred onto the sheet P is subjected to an amount of heat and pressure application, melted, attached firmly, and fixed on the sheet. Afterwards, the sheet P with the toner image fixed is discharged onto the discharge portion 91 through the transport rollers 12*b*.

On the other hand, at the time of a request for duplex image-forming, a sheet P that has gone through simplex image-forming and has passed through the fixing apparatus 7 as described above is transported to the reverse transport path S3 by the transport rollers 12*c* and 12*d* by reversing the rotation of the transport rollers 12*b* while the sheet P is being chucked by the transport rollers 12*b* on the switchback transport path S2, so that the upstream side end portion of the sheet P in the transport direction before being stopped is the front. Then, the sheet P transported to the reverse transport path S3 is guided to the upstream side of the transfer portion in the transport direction by the transport rollers 12*c* and 12*d*, and goes through the registration rollers 13, and then image-forming is performed on the reverse side and the sheet P is discharged to the discharge portion 91.

[Fixing Apparatus]

Figure 2:
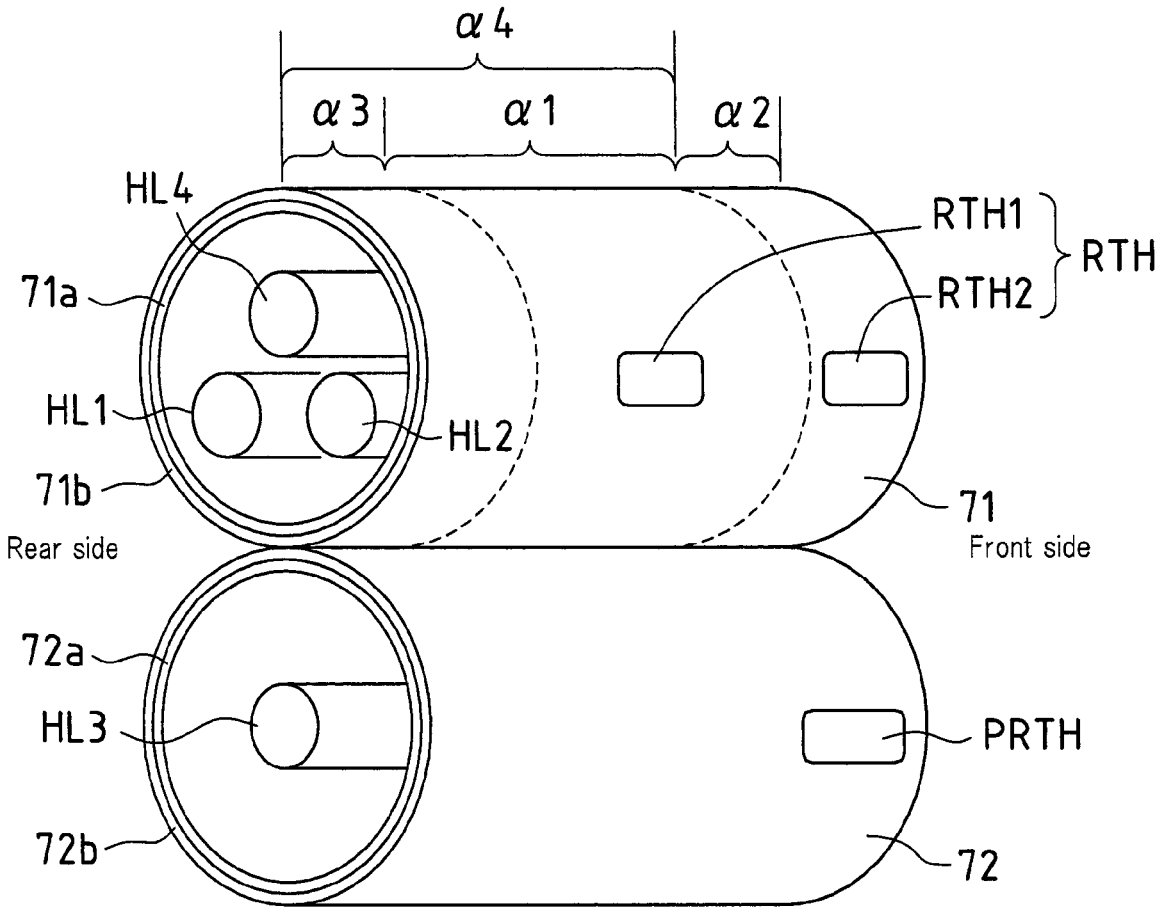
FIG. 2 is a diagram schematically illustrating the configuration of a portion of a fixing roller and a pressure roller in the fixing apparatus provided in the image forming apparatus shown in FIG. 1.

A fixing apparatus according to an embodiment of the present invention is described next with reference to the drawings. FIG. 2 is a diagram schematically illustrating a configuration of a portion of a fixing roller 71 and a pressure roller 72 in a fixing apparatus 7 provided in the image forming apparatus 100 shown in FIG. 1.

As shown in FIG. 2, the fixing apparatus 7 is provided with a fixing roller 71 and a pressure roller 72 that is disposed to face the fixing roller 71. The fixing roller 71 and the pressure roller 72 rotate with the sheet P interposed therebetween, and transport the sheet P toward the transport rollers 12*b*.

To be specific, the pressure roller 72 is pressed against the fixing roller 71 by a pressing means, which is not shown. The fixing roller 71 has a function of melting and pressure-bonding the toner image transferred to the sheet P (for example, melting, blending, and pressure-bonding the multicolor toner image) by thermocompression bonding the sheet P along with the pressure roller 72, thereby heat fixing the toner image to the sheet P. That is, the fixing roller 71 and the pressure roller 72 rotate in the direction of the transport of the sheet P, and at the pressure-bonding portion between the fixing roller 71 and the pressure roller 72, a fixing nip portion is formed. Thus, the fixing apparatus 7 can heat and melt the unfixed toner on the sheet P and apply a pressure and fix the unfixed toner onto the sheet P by transporting the sheet P to which the toner image is transferred while sandwiching the sheet P at the fixing nip portion between the fixing roller 71 and the pressure roller 72.

The fixing roller 71 may be configured, for example, so that an elastic layer 71*b* is provided at the peripheral surface of a cylindrical member (to be specific, a metal cored bar) 71*a*.

A plurality of (herein, two, i.e., a first and a second) fixing heaters, HL1 and HL2, are provided inside the fixing roller 71. To be specific, the first fixing heater HL1 and the second fixing heater HL2 are configured of a halogen heater lamp, and named a main heater and a sub heater, respectively. The first fixing heater (in the following, referred to as a main heater) HL1 and the second fixing heater HL2 (in the following, referred to as a sub heater) extend throughout the entire length in the longitudinal direction of the fixing roller 71.

Figure 3A:
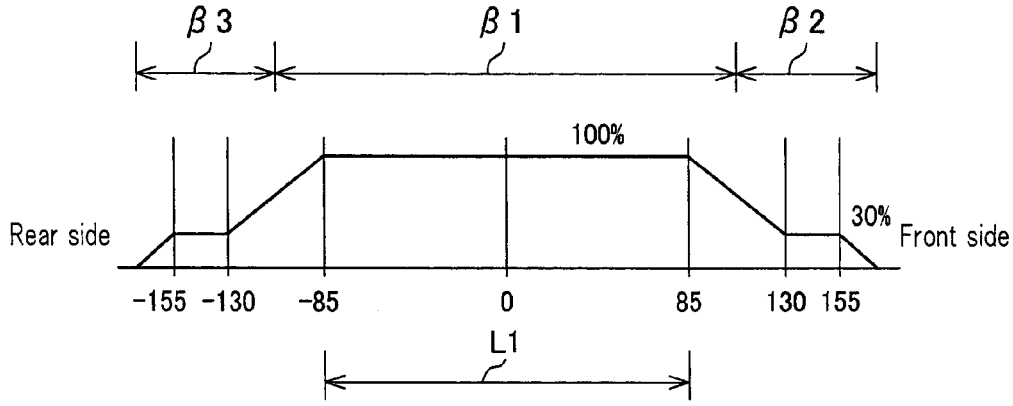
FIG. 3(*a*) to FIG. 3(*c*) are diagrams of the heat distribution characteristics along the longitudinal direction of the heater provided in the fixing roller.
Figure 3B:
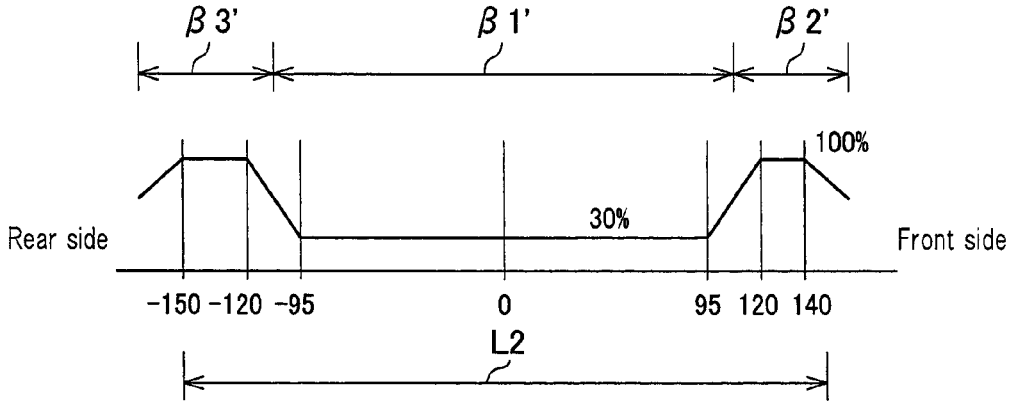
Figure 3C:
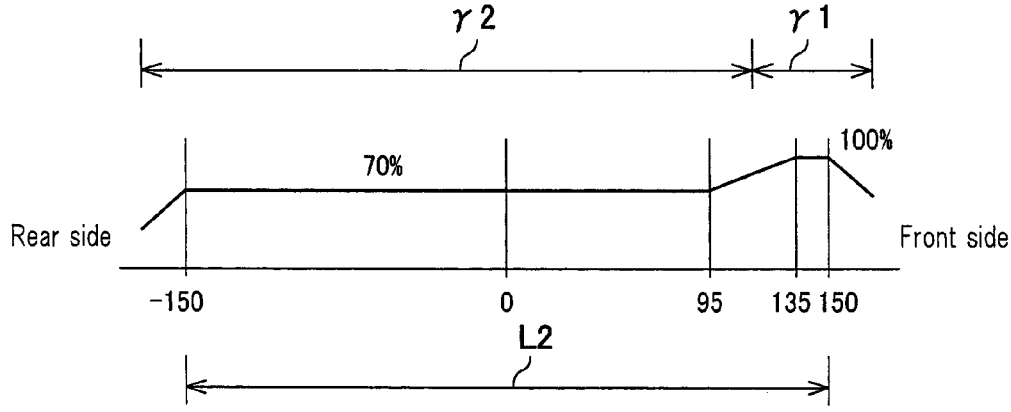

The main heater HL1 and the sub heater HL2 have heat distribution characteristics that are different from each other. FIG. 3(*a*) to FIG. 3(*c*) are diagrams of the heat distribution characteristics along the longitudinal direction of the heaters provided in the fixing roller 71: FIG. 3(*a*) shows the heat distribution characteristics of the main heater HL1, and FIG. 3(*b*) shows the heat distribution characteristics of the sub heater HL2. In FIG. 3(*a*) and FIG. 3(*b*), the vertical axis shows the ratio of the heat distribution along the longitudinal direction of the heater setting the maximum to 100%, and the horizontal axis shows the distance setting the center portion in the width direction of the sheet to 0 in the center-based transportation [unit: mm]. The same goes for FIG. 3(*c*) to be mentioned later as well.

As shown in FIG. 2, FIG. 3(*a*), and FIG. 3(*b*), in this embodiment, the main heater HL1 shows the heat distribution characteristics: a first heat distribution (ref: β1 in FIG. 3(*a*)) that mainly heats a first region (ref: α1 in FIG. 2) with a predetermined length along the longitudinal direction of the fixing roller 71 is higher than a second heat distribution (ref: β2 and β3 in FIG. 3(*a*)) that mainly heats a second region (ref: α2 and α3 in FIG. 2) other than the first region α1. The sub heater HL2 shows the heat distribution characteristics: a second heat distribution that mainly heats the second region α2 and α3 (ref: β2' and β3' in FIG. 3(*b*)) of the fixing roller 71 is higher than a first heat distribution (ref: β1' in FIG. 3(*b*)) that mainly heats the first region α1.

As shown in FIG. 1, in the fixing apparatus 7, an external heating belt 73 for heating the fixing roller 71 from outside can also be provided.

Then, inside the fixing roller 71, an auxiliary heater HL4 is further provided. Power is distributed to the auxiliary heater HL4 only during the warm-up period. The auxiliary heater HL4 in this embodiment is configured of a halogen heater lamp. The auxiliary heater HL4 extends throughout the entire length in the longitudinal direction of the fixing roller 71.

A temperature sensor (typically a thermistor) RTH, i.e., an example of a temperature measurement means, for measuring the surface temperature of the fixing roller 71 is provided around the fixing roller 71. The temperature sensor RTH in this embodiment includes two temperature sensors RTH1 and RTH2, i.e., a first and a second temperature sensors. The first temperature sensor RTH1 measures the temperature of the first region α1 at the surface of the fixing roller 71, and the second temperature sensor RTH2 measures the temperature of one of the second regions α2 and α3 of the surface of the fixing roller 71, in this case, α2.

Figure 7:
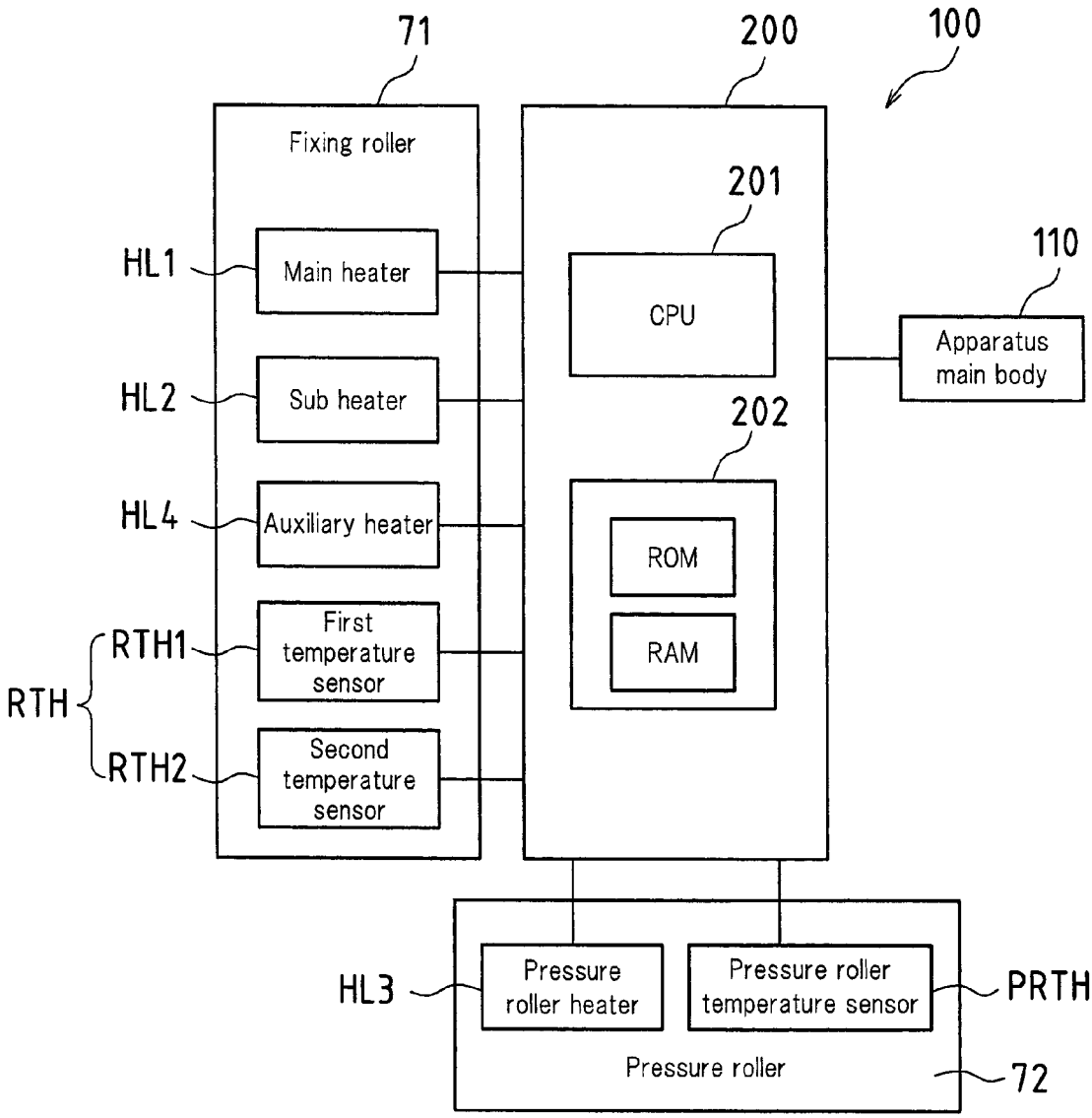
FIG. 7 is a block diagram schematically illustrating the constituent elements relating to the control of the fixing function of the fixing apparatus provided in the image forming apparatus shown in FIG. 1.

The temperature of the fixing roller 71 is controlled by a control unit 200 (ref: FIG. 7 to be mentioned later) as an example of a control means in the image forming apparatus 100 so that a predetermined fixing temperature (temperature when performing image-forming, for example, about 150° C.) is given during the ready period after the warm-up of the surface of the fixing roller 71, or a predetermined stand-by temperature (a temperature lower than the fixing temperature, for example, about 50° C.) during the stand-by period based on the measured values from the temperature sensor RTH (herein, the first temperature sensor RTH1 and the second temperature sensor RTH2).

To be specific, the main heater HL1 and the sub heater HL2 are controlled so as to give a fixing temperature to the surface of the fixing roller 71 during the ready period after the warm-up, or to give a stand-by temperature during the stand-by period based on the measurement output of the temperature sensor RTH with instruction from the control unit 200. Heater control during the warm-up period is described later.

Figure 4A:
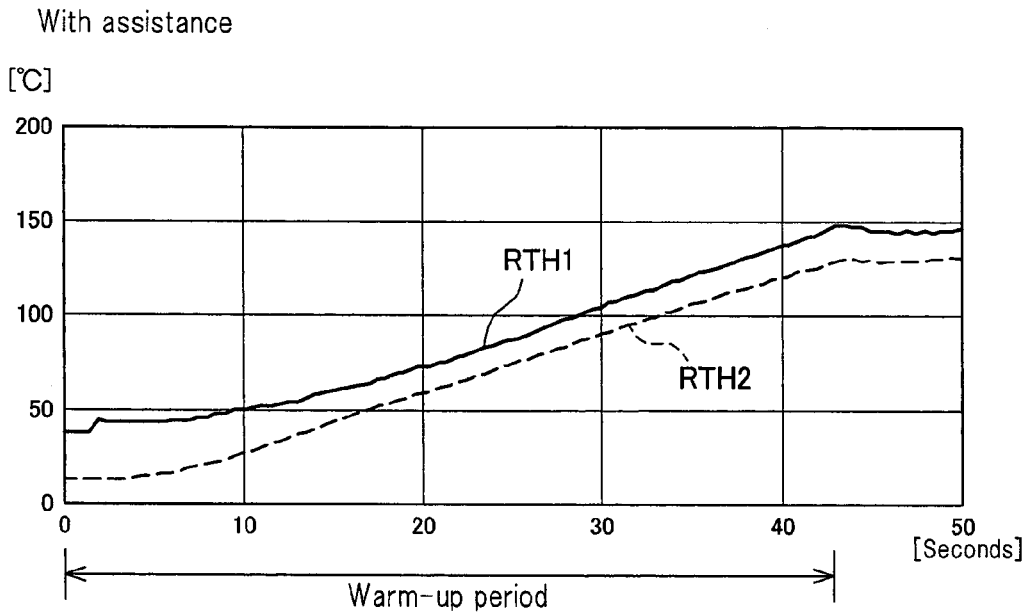
FIG. 4(*a*) and FIG. 4(*b*) are diagrams illustrating the changes over time in the surface temperature of the fixing roller during the warm-up period, where the fixing roller in a lower temperature state, i.e., when the main power supply has been OFF or during the stand-by mode, is heated.
Figure 4B:
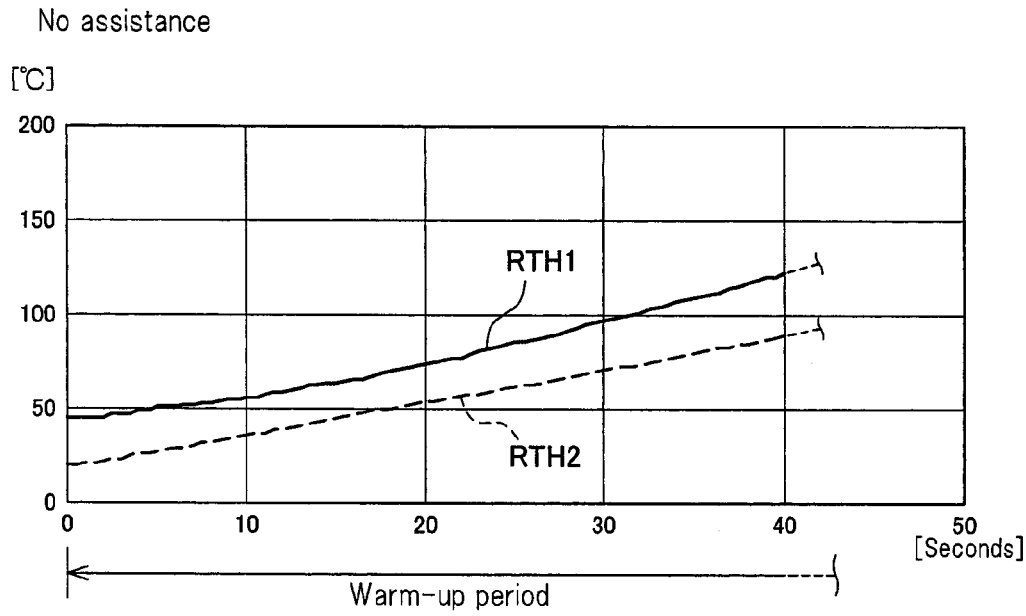

FIG. 4(*a*) and FIG. 4(*b*) are diagrams illustrating changes over time in the surface temperature of the fixing roller 71 during the warm-up period, where the fixing roller 71 in a low temperature state, i.e., when the main power supply has been OFF or during the stand-by mode, is heated: FIG. 4(*a*) shows the case where the fixing roller 71 is heated not only by the main heater HL1 and the sub heater HL2 but also by the auxiliary heater HL4 during the warm-up period (with assistance of the auxiliary heater HL4), and FIG. 4(*b*) shows the case where the fixing roller 71 is heated only by the main heater HL1 and the sub heater HL2, and not heated by the auxiliary heater HL4 during the warm-up period (no assistance from the auxiliary heater HL4). In FIG. 4(*a*) and FIG. 4(*b*), reference numeral RTH1 indicates the measurement value from the first temperature sensor RTH1, and the reference numeral RTH2 indicates the measurement value from the second temperature sensor RTH2.

As shown in FIG. 4(*b*), when starting up during the warm-up period until entering the ready (for example, capable of copying) state after turning the main power supply ON or when an instruction cancelling the stand-by mode is given, shortening of the starting up time, and an appropriate fixing temperature that can ensure fixing quality are required. One of the characteristics of the fixing roller 71 is that, for example, when the elastic layer 71*b* is provided at the roller peripheral surface, due to its effects on temperature, i.e., heat accumulation in the elastic layer 71*b* and heat transfer in its longitudinal direction, the heat can be spread uniformly to a certain degree and, thus, after a predetermined time has elapsed after power distribution to the fixing heater, the fixing ability can be ensured relatively stably. However, there are also limitations for such an elastic layer, and when an attempt to further shorten the start up time made, for the first sheet P immediately after the warm-up the fixing ability (for example, the fixing ability at the end portions in the sheet width direction) may not be sufficiently ensured.

In this regard, with the fixing apparatus 7 and the image forming apparatus 100 according to the embodiment of the present invention, as shown in FIG. 4(*a*), by providing the auxiliary heater HL4 to which power is distributed only during the warm-up period inside the fixing roller 71, the temperature of the fixing roller 71 during the warm-up period can be raised efficiently, and the warm-up period can be shortened to that extent.

Figure 5A:
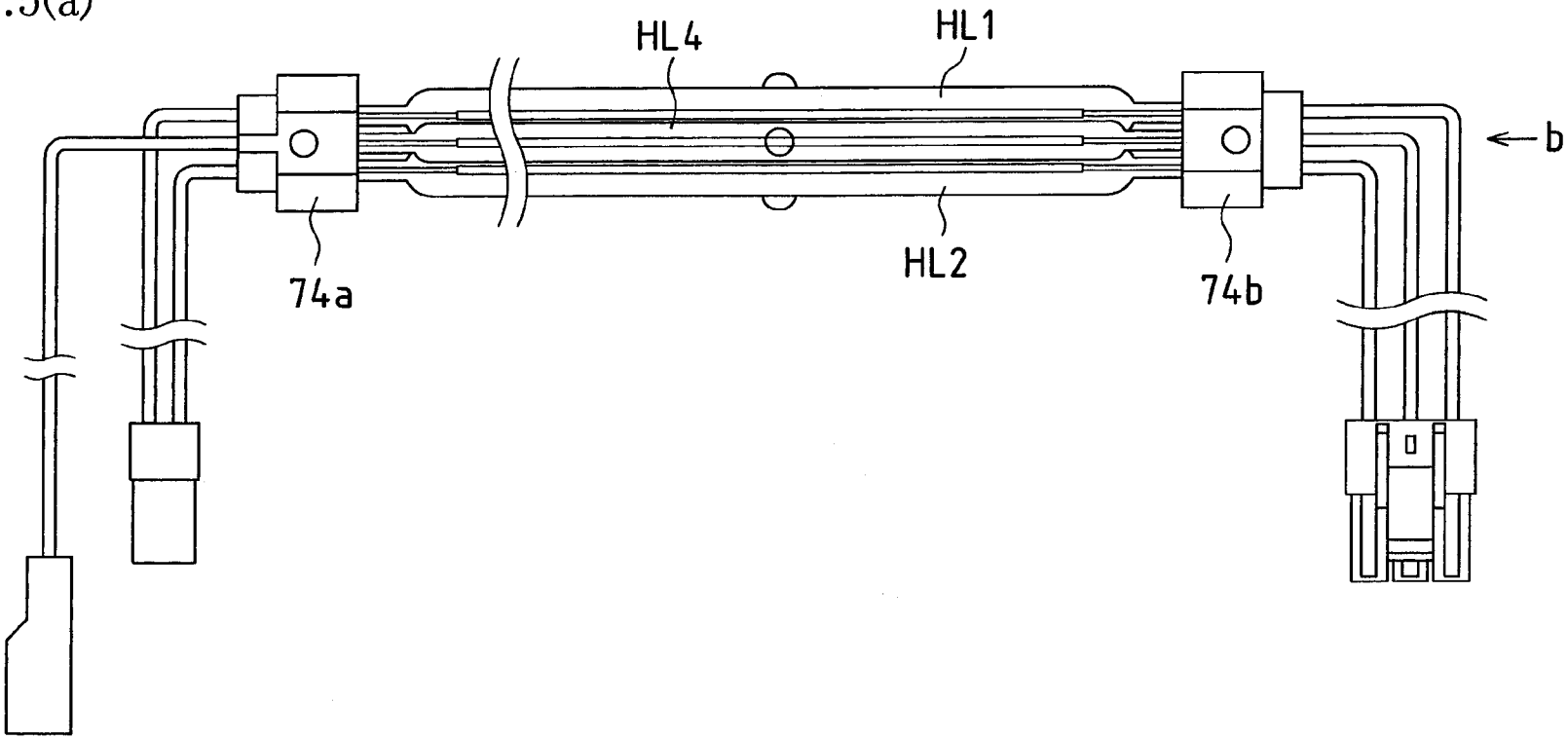
FIG. 5(*a*) and FIG. 5(*b*) are diagrams illustrating a schematic configuration of a plurality of fixing heaters and an auxiliary heater.
Figure 5B:
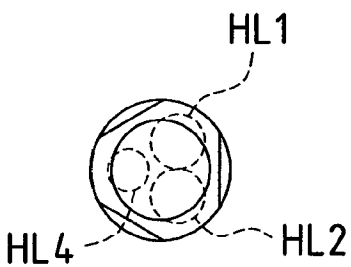

FIG. 5(*a*) and FIG. 5(*b*) are diagrams illustrating a schematic illustration of a plurality of fixing heaters HL1 and HL2, and the auxiliary heater HL4: FIG. 5(*a*) is a side view of the heaters HL1, HL2, and HL4, and FIG. 5(*b*) is a front view of the heaters HL1, HL2, and HL4 in the direction of arrow b in FIG. 5(*a*).

In this embodiment, as shown in FIG. 5(*a*) and FIG. 5(*b*), the plurality of fixing heaters HL1 and HL2, and the auxiliary heater HL4 are configured integrally. To be specific, the plurality of fixing heaters HL1 and HL2, and the auxiliary heater HL4 are integrally configured by being held by holding members 74*a* and 74*b* at both of their ends in the longitudinal direction.

Furthermore, in this embodiment, in the temperature distribution in the longitudinal direction of the fixing roller 71 that is heated by the plurality of fixing heaters HL1 and HL2, a temperature at a part of the image-forming region tends to be lower than the fixing temperature.

To be specific, as shown in FIG. 2, FIG. 3(*a*), and FIG. 3(*b*), the first heat distributions β1 and β1' of the main heater HL1 and the sub heater HL2 correspond to a heat distribution that mainly heats region α1 at the center portion of the fixing roller 71 in its longitudinal direction. One of the second heat distributions of the main heater HL1 and the sub heater HL2, β2 and β2', corresponds to a heat distribution that mainly heats one side of the end portions of the fixing roller 71 in its longitudinal direction (herein, front side), region α2. The other second heat distributions of the main heater HL1 and the sub heater HL2, β3 and β3', corresponds to a heat distribution that mainly heats the other side of the end portions of the fixing roller 71 in its longitudinal direction (herein, rear side), region α3.

In this embodiment, as shown in FIG. 3(*a*), the first heat distribution β1 of the main heater HL1, substantially corresponds to a length L1 in the width direction of a small size sheet that is smaller than the largest size sheet (the width direction along the longitudinal direction of the fixing roller 71). Also, as shown in FIG. 3(*b*), in the second heat distributions of the sub heater HL2, the region from the outer end of one of the second heat distributions, i.e., the heat distribution β2' (front side in the figure) to the outer end of the other one of the second heat distributions, i.e., the heat distribution β3' (rear side in the figure) substantially corresponds to a length L2 in the width direction of the largest size sheet.

In this fixing apparatus 7, in order to eliminate projections at the front side end portion of the fixing roller 71, the outer dimensional size of the front side end portion in the longitudinal direction is set to be narrow (no extra space), and the heat distribution characteristics of the sub heater HL2, as shown in FIG. 3(*b*), are that one (β2', front side) of the heat distributions is narrower than the other (β3', rear side) of the heat distributions among the second heat distributions β2' and β3' that mainly heat the second region, i.e., both end portion regions α2 and α3 in the fixing roller 71. In this way, the temperature distribution in the region α2 at the front side end portion cannot be sufficiently ensured relative to the temperature distribution in the center portion region α1 and the rear side end portion region α3 in the fixing roller 71, easily causing fixing failure, and thus taking time to reach the fixing temperature throughout the entire length in the longitudinal direction of the fixing roller 71 to ensure temperature distribution at the front side end portion region α2; however, in this embodiment, a configuration is made as follows.

Figure 6A:
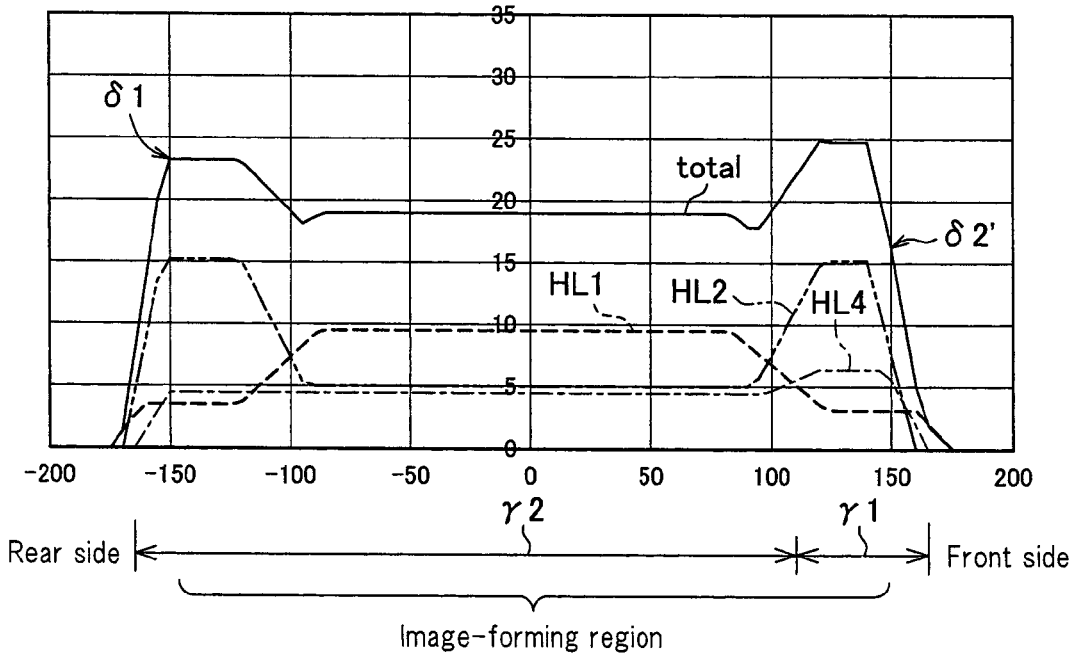
FIG. 6(*a*) and FIG. 6(*b*) are diagrams of the heat distribution characteristics illustrating the distribution of the heat capacity along the longitudinal direction of the main heater, the sub heater, and the auxiliary heater provided in the fixing roller, along with the distribution of their total.
Figure 6B:
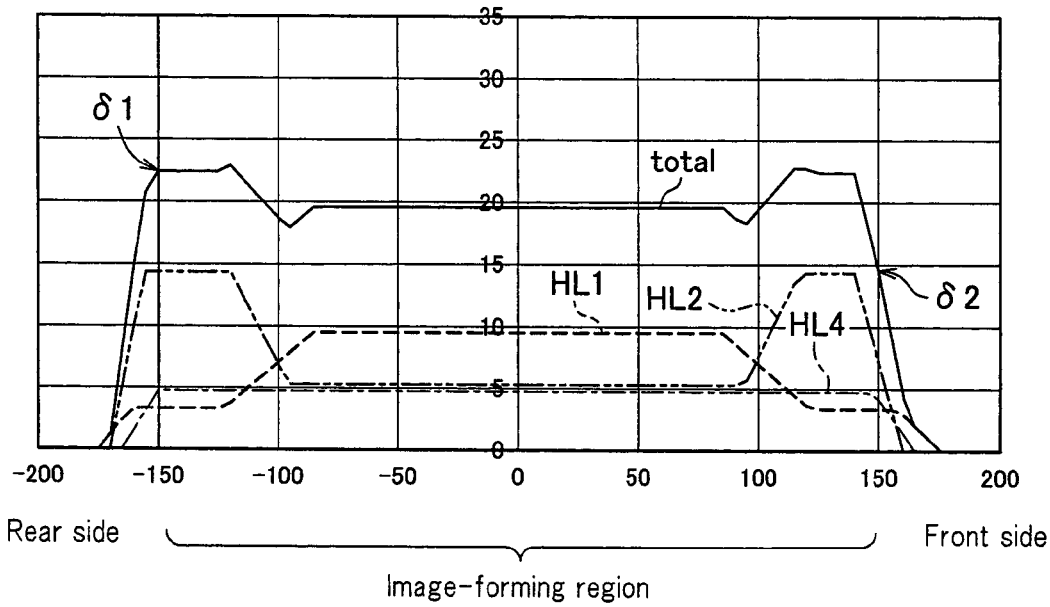

FIG. 6(*a*) and FIG. 6(*b*) are diagrams of heat distribution characteristics illustrating the distribution of the heat capacity along the longitudinal direction of the main heater HL1, the sub heater HL2, and the auxiliary heater HL4 provided in the fixing roller 71, along with the distribution of their total: FIG. 6(*a*) shows the case where a first heat distribution γ1 is set higher than a second heat distribution γ2 in the heat distribution characteristics of the auxiliary heater HL4 to be mentioned later, and FIG. 6(*b*) shows the case where the heat distribution characteristics of the auxiliary heater HL4' are uniform throughout the entire length in the longitudinal direction of the fixing roller 71. The "total" in the figure shows a total of the values of each heater.

In FIG. 6(*a*) and FIG. 6(*b*), the vertical axis is set to the heat capacity per unit length of the heater [unit: J/(K·m)], and the horizontal axis is set to a distance [unit: mm], setting the center portion in the width direction to 0 in the case of center-based transport and A4 sheet horizontal feeding (horizontal size of about 300 mm), +side corresponding to the front side of the apparatus, and −side corresponding to the rear side of the apparatus.

As shown in FIG. 6(*b*), although the heat distribution characteristics (ref: δ1) in the proximity of the horizontal axis −150 mm (rear side) are ensured to the end portion of the sheet, the heat distribution characteristics (ref: δ2) in the proximity of +150 (front side) are not sufficiently ensured to the end portion of the sheet.

Thus, the heat distribution characteristics of the auxiliary heater HL4 are set so that the heat distribution corresponding to the region where the temperature distribution is low in the fixing roller 71 is high. FIG. 3(*c*) shows the heat distribution characteristics of the auxiliary heater HL4.

To be specific, the heat distribution characteristics of the auxiliary heater HL4 are such that the first heat distribution (ref: γ1 in FIG. 3(*c*)) that mainly heats one end portion (herein, front side) region (ref: α2 in FIG. 2) in the longitudinal direction among the second regions, i.e., end portion regions α2 and α3 of the fixing roller 71, is set higher than the second heat distribution (ref: γ2 in FIG. 3(*c*)) that mainly heats the region other than the front side end portion (ref: α4 in FIG. 2).

Here, as shown in FIG. 3(*c*), the region from the outer end of the first heat distribution γ1 to the outer end of the second heat distribution γ2 in the auxiliary heater HL4 substantially corresponds to a length L2 in the width direction of the maximum size sheet.

With the fixing apparatus 7 of such a configuration, as shown in FIG. 6(*a*), because the heat distribution characteristics of the auxiliary heater HL4 are set so that the first heat distribution γ1 is higher than the second heat distribution γ2, the heat distribution characteristics in the proximity of +150 (ref: δ2') (front side) can be improved, and therefore, raising of the temperature of the fixing roller 71 during the warm-up period can be efficiently performed, and further, the warm-up period can be shortened.

[Fixing Roller Temperature Control]

FIG. 7 is a block diagram schematically illustrating constituent elements relating to control of the fixing function of the fixing apparatus 7 provided in the image forming apparatus 100 shown in FIG. 1.

A control unit 200 is provided with an information-processing device 201 such as a CPU (Central Processing Unit) and a memory unit 202. The memory unit 202 stores various control programs and necessary functions, and includes a ROM (Read Only Memory) and a RAM (Random Access Memory).

The control unit 200 performs control for controlling, through the CPU 201, the fixing functions of the fixing apparatus 7 by reading the various control programs from the memory unit 202 and executing the control programs that were read.

The control unit 200 may be configured to control the overall operation of the image forming apparatus in addition to the fixing functions of the fixing apparatus 7. In such a case, the control unit 200 further performs control processes relating to image-forming with the apparatus.

When the control unit 200 only controls the fixing apparatus 7, control of the fixing functions may be performed through communication with a control unit that controls the overall operation of the apparatus. In the following description, the overall operation of the apparatus is controlled by the control unit 200.

The control unit 200 is configured so as to perform, through the CPU 201, power distribution control (for example, heater control based on the measurement output of the temperature sensor during the ready or stand-by period, and warm-up period, which is to be mentioned later) of each heater based on the surface temperatures of the rollers measured by the temperature sensors through drivers, which are not shown.

To be specific, the temperature sensor RTH is electrically connected to an input system of the control unit 200 so that the measurement values of the surface temperatures of the fixing roller 71 can be inputted into the control unit 200 (herein, so that the first and the second temperature sensors RTH1 and RTH2 can input the temperature measurement values for the first region α1 and the second region α2 of the fixing roller 71, respectively, into the control unit 200).

Furthermore, the control unit 200 is configured so that power is distributed to the auxiliary heater HL4 during the warm-up period, and power distribution to the auxiliary heater HL4 is stopped when it is detected that the fixing roller 71 has reached the fixing temperature based on the measurement value of the temperature sensor RTH (herein, the first temperature sensor RTH1 and the second temperature sensor RTH2).

Thus, power can be distributed to the auxiliary heater HL4 only during the warm-up period, and the temperature of the fixing roller 71 can be efficiently raised during the warm-up period.

In this embodiment, the pressure roller 72 may also have a configuration in which the elastic layer 72*b* is provided at the peripheral surface of a cylindrical member (to be specific, a metal cored bar) 72*a*, for example, in the same manner as the fixing roller 71. In this embodiment, a pressure roller fixing heater (herein, a heater configured of a halogen heater lamp and, in the following, referred to as a pressure roller heater) HL3 is provided inside the pressure roller 72. The pressure roller heater HL3 extends throughout the entire length in the longitudinal direction of the pressure roller 72. Furthermore, around the pressure roller 72, a pressure roller temperature sensor (typically a thermistor) PRTH for measuring the surface temperature of the pressure roller 72 is provided.

Furthermore, the control unit 200 is configured so that power distribution to the auxiliary heater HL4 is performed along with the power distribution to the main heater HL1 during the warm-up period, but power distribution to the auxiliary heater HL4 is not performed despite the power distribution to the main heater HL1 during the ready period after the warm-up, and during the stand-by period. Furthermore, the control unit 200 is configured so that power distribution to at least one of the sub heater HL2 and the pressure roller heater HL3 is not performed when power is distributed to the auxiliary heater HL4.

FIG. 8(*a*) to FIG. 8(*c*) are diagrams illustrating examples of control tables storing heater power-on conditions for performing power distribution control to the heaters based on the temperature measurement values from the temperature sensors through the control unit 200 provided in the image forming apparatus 100 shown in FIG. 1: FIG. 8(*a*) shows heater power-on conditions for the warm-up period, FIG. 8(*b*) shows heater power-on conditions for the stand-by period, and FIG. 8(*c*) shows heater power-on conditions for the ready period (for example, during copying period).

In FIG. 8(*a*) to FIG. 8(*c*), the RTH1 row of a table corresponds to the first temperature sensor that measures the temperature of the first region α1 of the fixing roller 71, the RTH2 row of a table corresponds to the second temperature sensor that measures the temperature of the second region α2 of the fixing roller 71, and the PRTH row of a table corresponds to the pressure roller temperature sensor that measures the surface temperature of the pressure roller 72. In these tables, "L" indicates the case where the value of the temperature sensor is equal to or lower than the target temperature, and "HH" indicates the case where the value of the temperature sensor is higher than the target temperature. The "target temperature" refers to a fixing temperature during the warm-up period and ready period (in the following, referred to as a copying period), and refers to the stand-by temperature during the stand-by period.

In FIG. 8(*a*) to FIG. 8(*c*), the HL1 row of a table corresponds to a main heater of 480 W, the HL2 row of a table corresponds to a sub heater of 510 W, the HL3 row of a table corresponds to a pressure roller heater of 300 W, and the HL4 row of a table corresponds to an auxiliary heater of 300 W. In these tables, those cells with the watt value shown indicate the controlled distribution of power to corresponding heaters, and those cells where "OFF" is shown indicate the controlled non-distribution of power to corresponding heaters.

Furthermore, the "total" shown in FIG. 8(*a*) to FIG. 8(*c*) indicates the total watt value of the heaters to which the power is distributed.

As shown in FIG. 8(*a*) to FIG. 8(*c*), the auxiliary heater HL4 is turned on only during the warm-up period in synchronization with the main heater HL1, but turned off during the time other than the warm-up period, i.e., stand-by and copying periods. By thus controlling the four heaters, i.e., the main heater HL1, the sub heater HL2, the pressure roller heater HL3, and the auxiliary heater HL4 through the control unit 200, temperature control during the warm-up, stand-by, and copying periods is performed efficiently.

The control unit 200 is preferably configured so as not to distribute power to the pressure roller heater HL3 while power is distributed to the auxiliary heater HL4.

Based on such a configuration, for example, the temperature of the fixing roller 71 can be raised efficiently while maintaining the capacity of the heaters as a whole in view of the limitations from current ratings for indoor circuit breakers and the like provided at the place where the apparatus is located.

Furthermore, electrical power consumption can be decreased while power is distributed to the auxiliary heater HL4 by not distributing power to the pressure roller heater HL3.

The present invention can be embodied in other different forms without departing from the purport and essential characteristics thereof. Therefore, the above-described examples are considered in all respects as illustrative and not restrictive. The scope of the invention is indicated by the appended claims rather than by the foregoing description. All variations and modifications falling within the range of equivalency of the appended claims are intended to be embraced therein.

What is claimed is:

1. A fixing apparatus provided in an image forming apparatus and including a fixing roller, the fixing apparatus comprising:

a plurality of fixing heaters provided inside the fixing roller and having heat distribution characteristics that are different from each other, and an auxiliary heater provided inside the fixing roller, to which power is distributed only during a warm-up period until the fixing roller in a lower temperature state reaches a predetermined fixing temperature, wherein a temperature distribution in a longitudinal direction of the fixing roller that is heated by the plurality of fixing heaters is low in a partial region, and heat distribution characteristics of the auxiliary heater are such that a heat distribution corresponding to the partial region where the temperature distribution is low in the fixing roller is high, and wherein the plurality of fixing heaters include:

a first fixing heater having heat distribution characteristics by which a first heat distribution that mainly heats a center portion region of a predetermined length along the longitudinal direction of the fixing roller is higher than a second heat distribution that mainly heats both end portion regions other than the center portion region, and a second fixing heater having heat distribution characteristics by which second heat distributions that mainly heat the both end portion regions of the fixing roller are higher than a first heat distribution that mainly heats the center portion region;

the heat distribution characteristics of the second fixing heater are such that one heat distribution is narrower than the other heat distribution among the second heat distributions that mainly heat the both end portion regions; and the heat distribution characteristics of the auxiliary heater are such that a first heat distribution that mainly heats the one end portion region of the both end portion regions is higher than a second heat distribution that mainly heats a region other than the one end portion region.

2. An image forming apparatus comprising:

the fixing apparatus according to claim 1, a temperature measurement unit that measures a temperature of the fixing roller, and a control unit that controls the temperature of the fixing roller based on the measurement value from the temperature measurement unit, wherein the control unit distributes power to the auxiliary heater during the warm-up period, and when it is detected that the fixing roller has reached the fixing temperature based on the measurement value from the temperature measurement unit, stops to distribute power to the auxiliary heater.

3. The image forming apparatus according to claim 2, further comprising:

a pressure roller for applying pressure toward the fixing roller, and a pressure roller fixing heater provided inside the pressure roller, wherein the control unit does not distribute power to the pressure roller fixing heater when power is distributed to the auxiliary heater.

* * * * *